US011859324B2

(12) United States Patent
Tseng

(10) Patent No.: US 11,859,324 B2
(45) Date of Patent: Jan. 2, 2024

(54) DRIVING CLUTCH DEVICE FOR A SEWING MACHINE

(71) Applicant: Hsien-Chang Tseng, Taichung (TW)

(72) Inventor: Hsien-Chang Tseng, Taichung (TW)

( * ) Notice: Subject to any disclaimer, the term of this patent is extended or adjusted under 35 U.S.C. 154(b) by 69 days.

(21) Appl. No.: 17/651,096

(22) Filed: Feb. 15, 2022

(65) Prior Publication Data

US 2023/0175181 A1 Jun. 8, 2023

(30) Foreign Application Priority Data

Dec. 8, 2021 (TW) ..... 110145798

(51) Int. Cl.
*D05B 69/12* (2006.01)
*D05B 69/34* (2006.01)
*D05B 69/18* (2006.01)

(52) U.S. Cl.
CPC ..... *D05B 69/34* (2013.01); *D05B 69/125* (2013.01); *D05B 69/18* (2013.01)

(58) Field of Classification Search
CPC ..... D05B 69/34; D05B 69/125; D05B 69/18; D05B 69/16; D05B 69/04; D05B 69/02
See application file for complete search history.

(56) References Cited

U.S. PATENT DOCUMENTS 3,388,681 A * 6/1968 Fujita ..... D05B 69/16 475/321
4,522,140 A * 6/1985 Koide ..... D05B 69/34 192/69.61
2015/0233034 A1* 8/2015 Tseng ..... D05B 55/16 112/221

FOREIGN PATENT DOCUMENTS

FR 413961 A * 8/1910 ..... D05B 69/34
GB 161974 A * 10/1921 ..... D05B 69/16

* cited by examiner

*Primary Examiner* — Patrick J. Lynch
(74) *Attorney, Agent, or Firm* — Wang Law Firm, Inc.

(57) ABSTRACT

A driving clutch device for a sewing machine includes a drive shaft, a passive member, a clutch seat, an actuating seat, a power unit, and a clutch member. Through fixing the passive member and the clutch seat onto the drive shaft, rotatably disposing the actuating seat, the drive shaft, and returnably disposing the clutch member to the clutch seat, the clutch seat and the actuating seat are able to move synchronously when the clutch member is in the engaged position, but not to move synchronously when the clutch member in the disengaged position, thereby achieving the driving and clutch controls only by the clutch member, the passive member, the clutch seat and the actuating seat. Therefore, the driving clutch device is simpler and the driving is more direct and instant, thereby reducing assembly costs and the error of action coordination.

9 Claims, 12 Drawing Sheets

DRIVING CLUTCH DEVICE FOR A SEWING MACHINE

BACKGROUND

Field of the Invention

The present invention relates to a sewing machine, and more particularly to a driving clutch device for a sewing machine.

Description of Related Art

The existing sewing machine uses a power unit to drive a driving shaft and drive a related loop-stitching thread hooking mechanism to cooperate with a needle to reciprocate between the top and bottom dead points, and a feed dog unit also works with the up and down reciprocating movement of the needle to carry out fabric feeding action. The up and down reciprocating movement of the needle in conjunction with the thread hooking and the fabric feeding action of the cloth feeding unit enables sewing stacks, such as the interlock stitching, stranding, hemming, decoration, and splicing.

Moreover, the sewing machine also enables that the power unit and the parts, rotatably sleeving on the drive shaft, can stay in a driven or non-driven state according to the needs of the user. However, to drive the parts rotatably sleeving on the drive shaft, the driving and clutch devices of the existing sewing machine need many driving transmission components, and too many driving components cause a complicated structure, resulting in the defects of time-consuming and labor-intensive in assembling, and of high costs. For transmission, too many transmission components would cause these transmission components cannot be directly driven immediately, resulting in errors in the drive, which can easily cause errors in the coordination between the loop-stitching thread hooking and the moving of the needle, and further cause unnecessary sewing errors.

SUMMARY

One objective of the present invention is to provide a driving clutch device for a sewing machine, and the driving clutch device mainly reduces the assembly cost and enables more direct and reliable driving.

To solve the aforementioned disadvantages, a driving clutch device for a sewing machine in the invention includes: a drive shaft; a passive member fixed to the drive shaft; a clutch seat fixed to the drive shaft and including a through hole; an actuating seat pivotally disposed to the drive shaft and including a clutch hole; a power unit including a power rod and a driving member connected to the power rod, the driving member being pivotally connected to the actuating seat, and the power rod being configured to drive the driving member to move, so as to further drive the actuating seat to pivot reciprocatingly around an axis of the drive shaft; and a clutch member returnably disposed to the clutch seat and movable between an engaged position and a disengaged position, the clutch member including a clutch lever, and the clutch lever being configured to be inserted in the through hole of the clutch seat spinnable, wherein when the clutch member is in the engaged position, the clutch lever is inserted into both the through hole of the clutch seat and the clutch hole of the actuating seat, so that the actuating seat is moved synchronously with the clutch seat, and the passive member is driven by the drive shaft, and when the clutch member is in the disengaged position, the clutch lever is inserted into the through hole of the clutch seat but is disengaged from the clutch hole of the actuating seat, so that the actuating seat does not move synchronously with the clutch seat.

The effects of the invention are listed as follows. The passive member, the clutch seat, and the actuating seat are fixed on the drive shaft, and the clutch member is designed to be returnably disposed to the clutch seat, whereby the clutch seat and the actuating seat can move synchronously when the clutch member is in the engaged position, but can not move synchronously when the clutch member in the disengaged position, so as to achieve the driving control and the clutch control. The present invention achieves the driving control and the clutch control only by the cooperation of the clutch member with the passive member, the clutch seat and the actuating seat, so that the design of the driving clutch device may be simpler and more direct and instant driving may be achieved, thereby reducing assembly costs and the error of action coordination.

Preferably, the clutch member further includes a controlled portion, the driving clutch device further includes a clutch linkage member and a clutch operation member, the clutch linkage member includes a first pivotable mounting portion, an elongated guiding slot, and a pushing portion for pushing the clutch member to move from the engaged position to the disengaged position, the clutch operation member includes a second pivotable mounting portion, an operatable portion for being moved, and an actuating protrusion for being inserted in the elongated guiding slot of the clutch linkage member and interactively moved with the elongated guiding slot, the clutch operation member is able to pivot from a first position and a second position on the second pivotable mounting portion as a pivot; when the clutch operation member is pivoted to the first position by pulling the operatable portion, the pushing portion corresponds to the controlled portion to keep the clutch member in the engaged position; and when the clutch operation member is pivoted to the second position by pulling the operatable portion, the actuating protrusion pushes against a wall surface of the elongated guiding slot, so that the pushing portion pushes against the controlled portion of the clutch member to move the clutch member from the engaged position to the disengaged position.

Preferably, the clutch member further includes a controlled portion, the driving clutch device further includes a clutch linkage member and a clutch operation member, the clutch linkage member includes a first pivotable mounting portion, an actuating protrusion, and a pushing portion for pushing the clutch member to move from the engaged position to the disengaged position, the clutch operation member includes a second pivotable mounting portion, an operatable portion for being moved, and an elongated guiding slot for the actuating protrusion to insert and for guiding and being guided by the actuating protrusion, the clutch operation member is able to pivot from a first position and a second position on the second pivotable mounting portion as a pivot; when the clutch operation member is pivoted to the first position by pulling the operatable portion, the pushing portion corresponds to the controlled portion to keep the clutch member in the engaged position; and when the clutch operation member is pivoted to the second position by pulling the operatable portion, the actuating protrusion is pushed by the clutch operation member at a wall surface of the elongated guiding slot, so that the pushing portion pushes against the controlled portion of the clutch member to move the clutch member from the engaged position to the disengaged position.

Preferably, the power rod is a spinnable shaft.

Preferably, the power rod is provided with an eccentric wheel, and the power rod drives the driving member by the eccentric wheel to further drive the actuating seat to pivot reciprocatingly around the axis of the drive shaft.

Preferably, the driving member drives the actuating seat with a universal joint.

Preferably, the clutch seat includes a limit groove, the driving clutch device further includes a limit rod fixed to the clutch member, the limit rod includes a limit rod portion that is inserted into the limit groove while being movable together the clutch member.

Preferably, the driving clutch device for the sewing machine further includes a return spring, and the return spring includes a first spring end disposed to the clutch seat, and a second spring end disposed to the clutch member, so that the clutch member is automatically returnable to the engaged position when located in the disengaged position.

Preferably, the clutch seat and the passive member are integrally formed as one piece.

DETAILED DESCRIPTION

Figure 1:
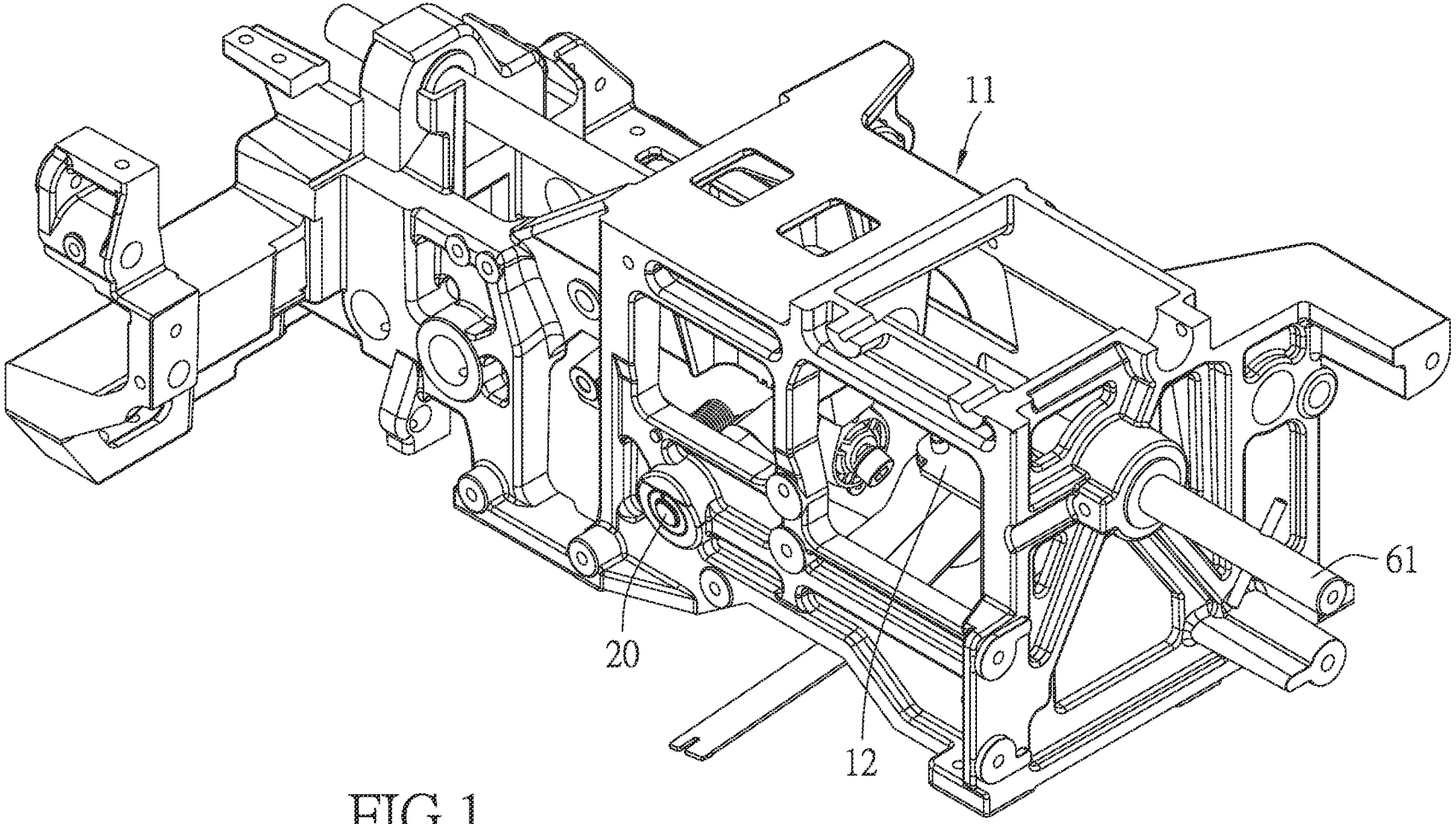
FIG. 1 shows that the present invention is installed on a machine base.
Figure 2:
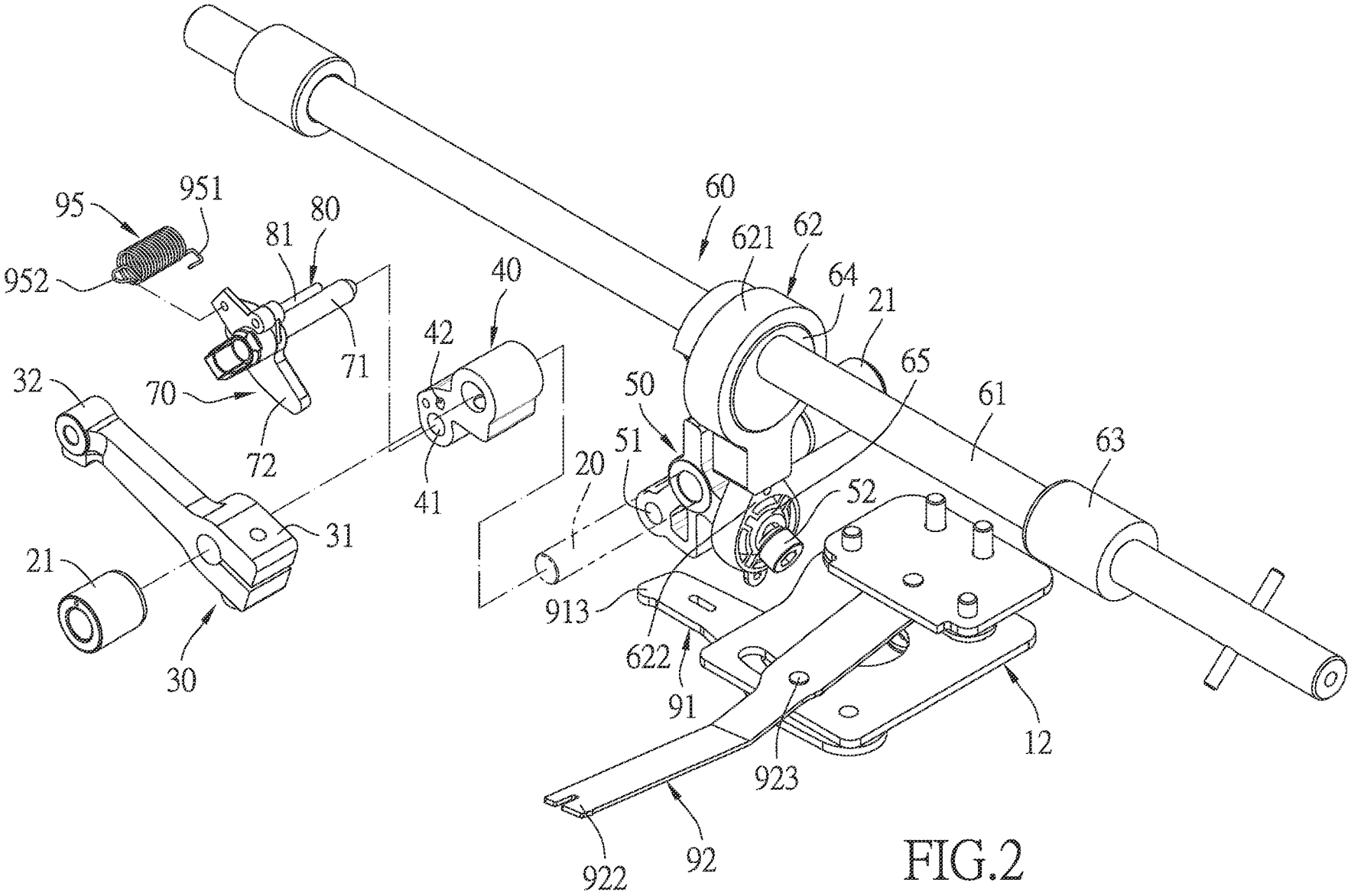
FIG. 2 is a three-dimensional exploded view of a part of an embodiment of the present invention, showing that a passive member, a clutch seat, and a clutch member are disengaged from a drive shaft.

Please refer to FIG. 1 to FIG. 6, a driving clutch device for a sewing machine provided by an embodiment of the present invention is suitable for being installed to a machine frame 11 which is provided with a fixing plate assembly 12. The driving clutch device of the sewing machine includes a drive shaft 20, a passive member 30, a clutch seat 40, an actuating seat 50, a power unit 60, a clutch member 70, a limit rod 80, a clutch linkage member 91, and a clutch operation member 92.

Two opposite ends of the drive shaft 20 are rotatably disposed to the machine frame 11 by bearings 21.

The passive member 30 includes a passive fixing portion 31 fixed on the drive shaft 20, and a passive connecting portion 32 opposite to the passive fixing portion 31. The passive connecting portion 32 can be connected to a hook arm which is provided with an annular hook (not shown in the figure), but not limited to this implementation; and in this or other embodiments, the passive connecting portion 32 can be connected to any other part of the sewing machine that need to be controlled.

The clutch seat 40 is fixed on the drive shaft 20 and includes a through hole 41 and a limit groove 42 which are arranged to parallel an axis of the drive shaft 20. In another embodiment, the clutch seat 40 and the passive member 30 are integrally formed as an integrated structure, thereby reducing the amount of parts and the assembly costs more.

The actuating seat 50 is rotatably disposed to (e.g. rotatably sleeves on) the drive shaft 20 and includes a clutch hole 51 arranged to parallel the axis of the drive shaft 20, and the clutch hole 51 can correspond to (e.g. aim at) the through hole 41 of the clutch seat 40; and in this embodiment, the actuating seat 50 is further provided with a universal rod 52.

Figure 3:
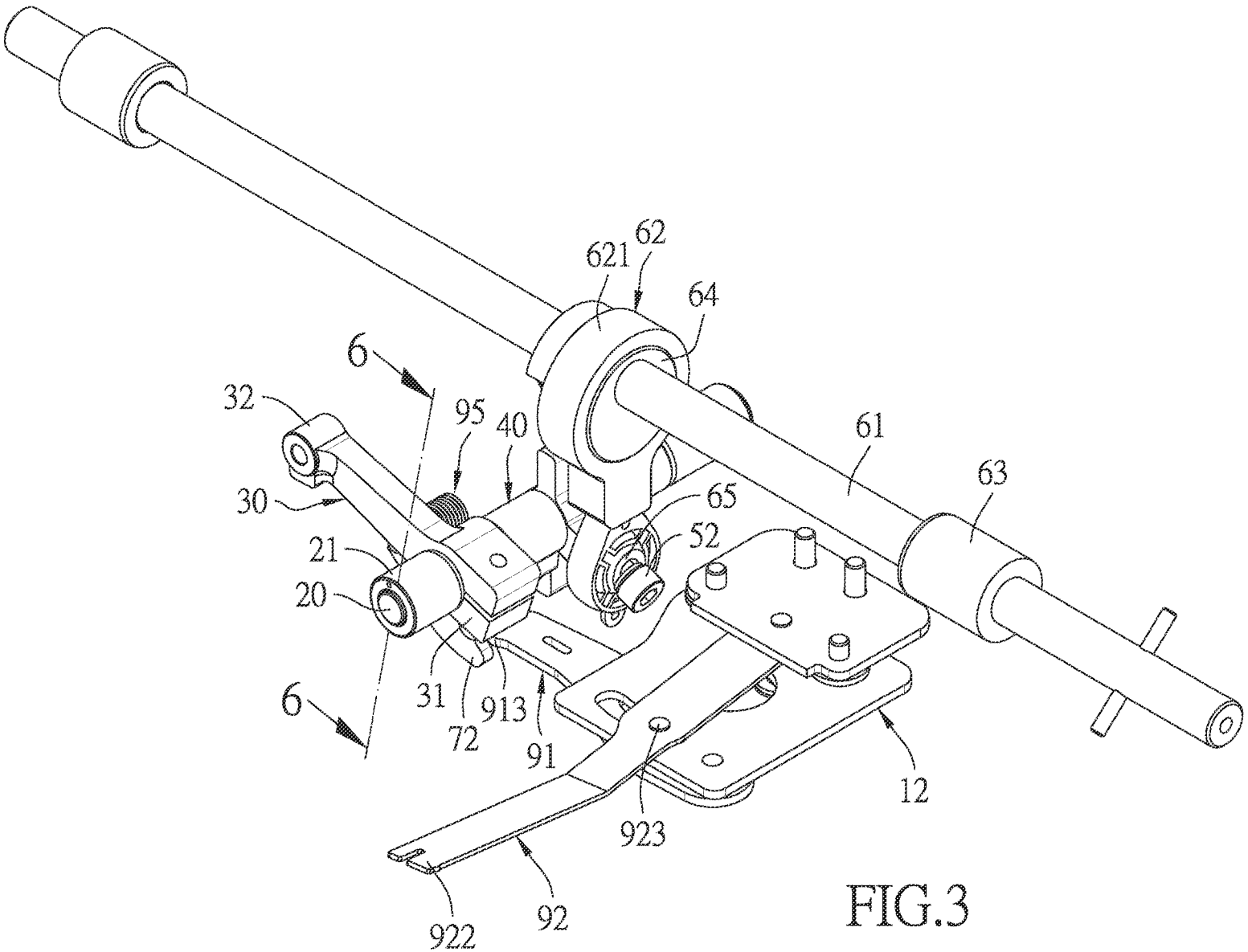
FIG. 3 is a perspective view of an embodiment of the present invention.
Figure 7:
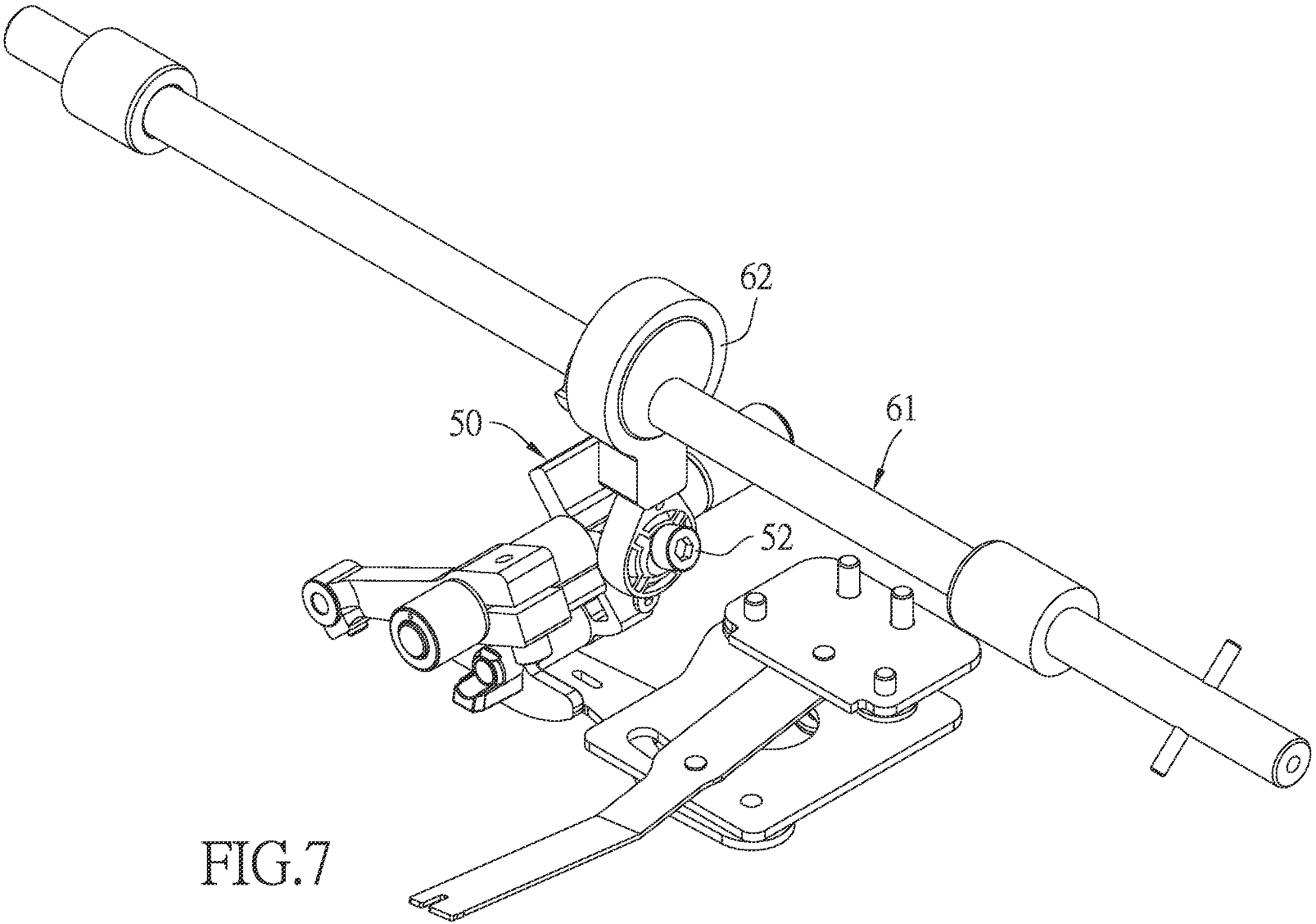
FIG. 7 is a view of the operation of an embodiment of the present invention, showing the operation state of a power unit.

The power unit 60 includes a power rod 61 and a driving member 62 connected to the power rod 61. The driving member 62 is pivotally connected to the actuating seat 50, and the power rod 61 drives the driving member 62 to move, so as to further drive the actuating seat 50 to reciprocatingly pivot around (rotate/spin about) the axis of the drive shaft 20. In this embodiment, two opposite ends of the power rod 61 are rotatably disposed to the machine frame 11 by bearings 63, the power rod 61 is a spinnable shaft and is also provided with an eccentric wheel 64, the driving member 62 includes a first sleeve portion 621 sleeves on the eccentric wheel 64, and a second sleeve portion 622 provided with a universal joint 65 capable of multi-angle pivoting. The universal joint 65 is connected to the universal rod 52 of the actuating seat 50, so that the power rod 61 is able to drive the driving member 62 to further drive the actuating seat 50 to reciprocatingly pivot around (rotate/spin about) the axis of the drive shaft 20. As shown in FIG. 3, the power rod 61 drives the driving member 62 to move to a bottom dead point, so that the actuating seat 50 and the universal rod 52 provided thereon are pivoted downward. As shown in FIG. 7, the power rod 61 drives the driving member 62 to a top dead point, so that the actuating seat 50 and the universal rod 52 provided thereon are pivoted upward.

Figure 6:
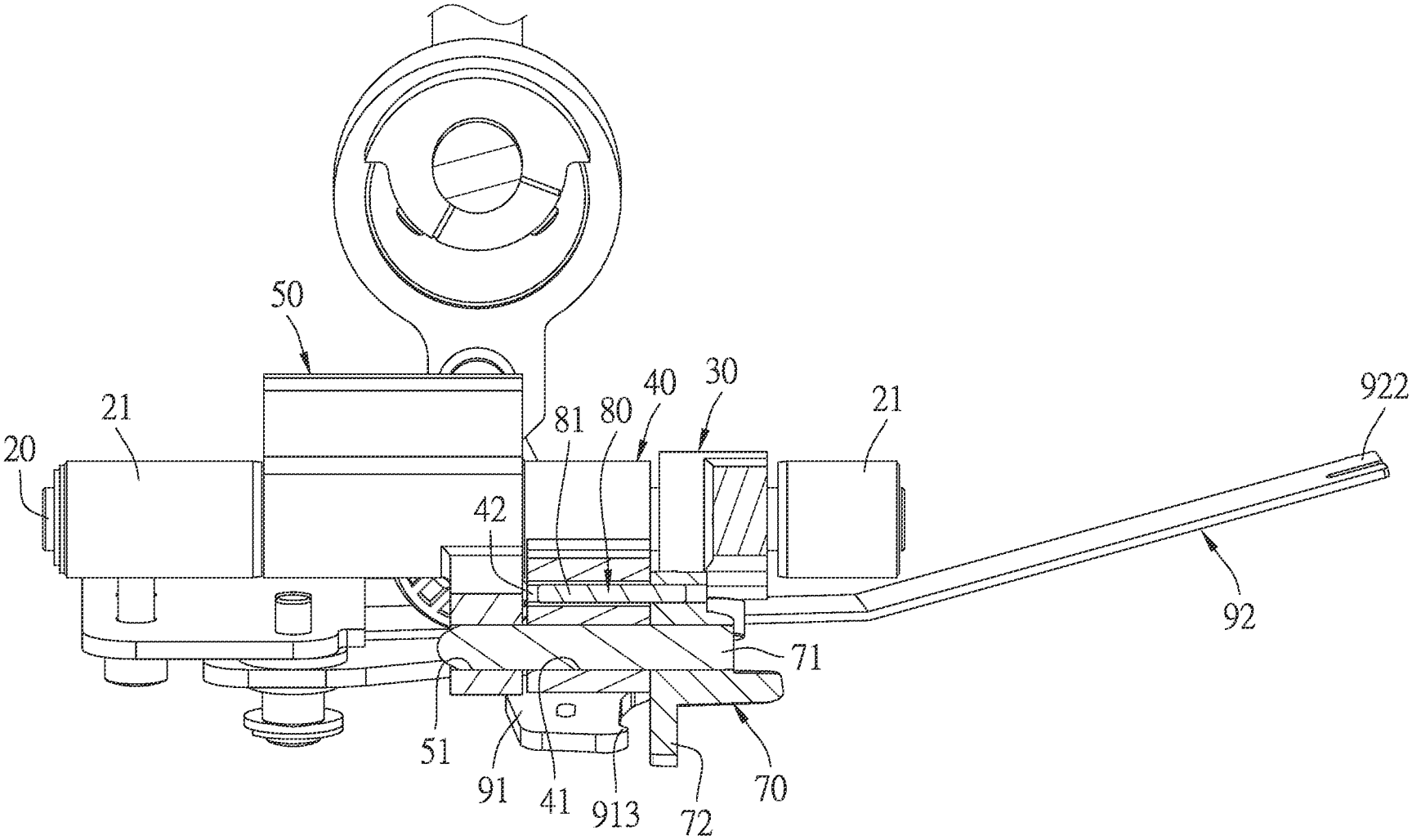
FIG. 6 is a cross-sectional view in a line 6-6 of FIG. 3, showing a clutch member in an engaged position.
Figure 8:
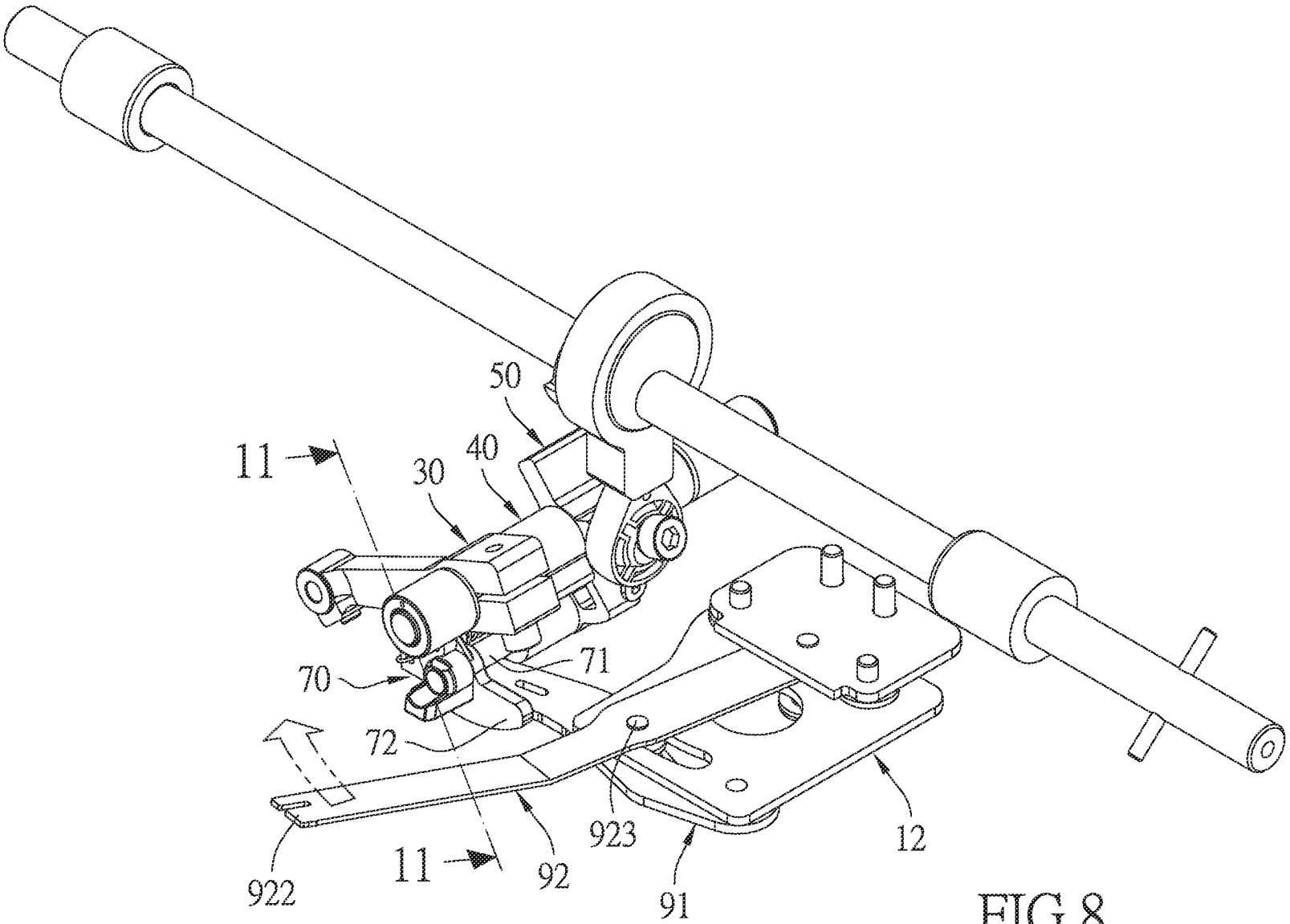
FIG. 8 is a view of the operation of an embodiment of the present invention, showing a clutch member in a disengaged position.
Figure 11:
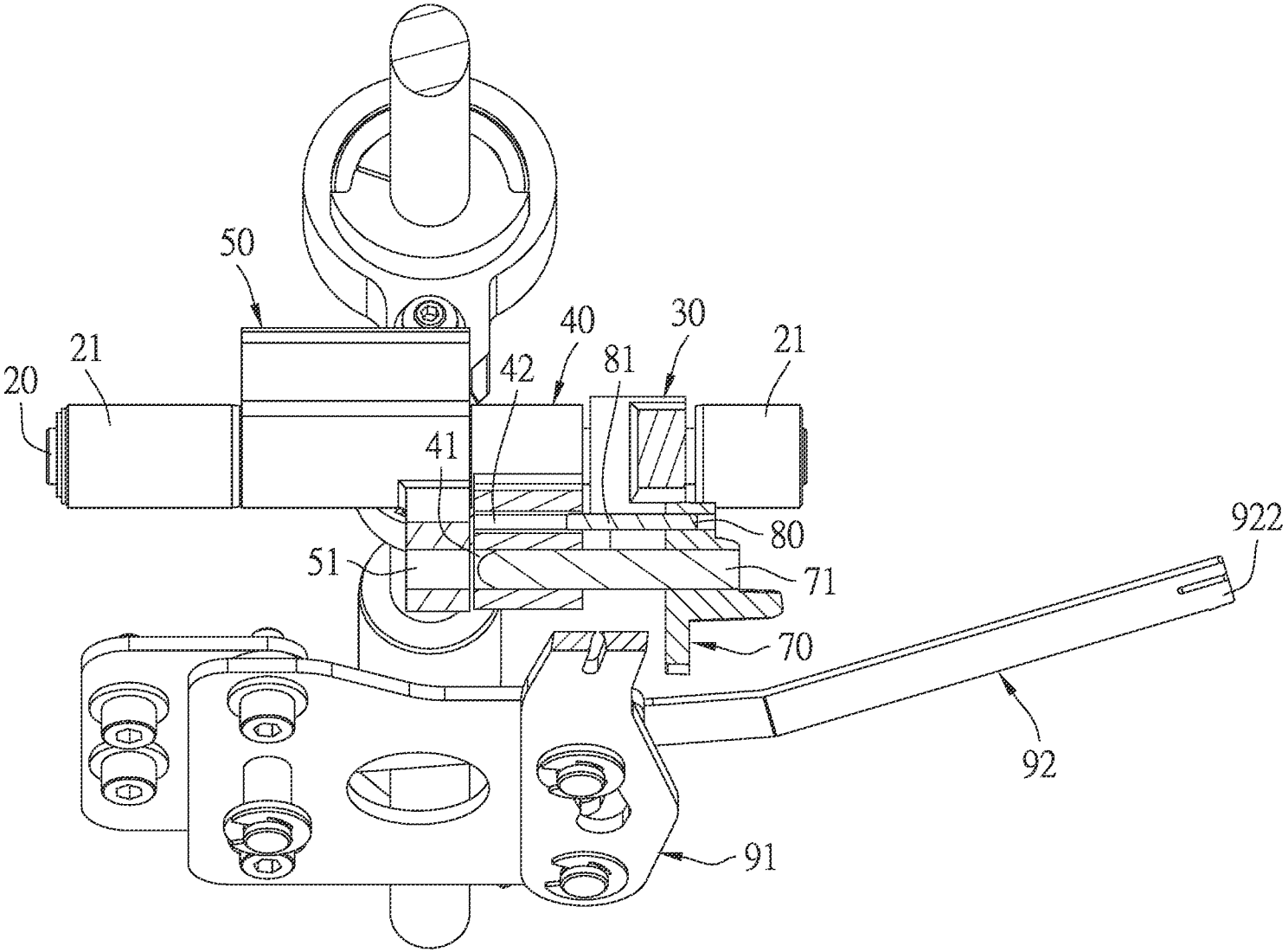
FIG. 11 is a cross-sectional view in a line 11-11 of FIG. 8, showing a clutch member in a disengaged position.

The clutch member 70 is returnably disposed to the clutch seat 40 and is movable between an engaged position (shown in FIGS. 3 and 6) and a disengaged position (shown in FIGS. 8 and 11). The clutch member 70 includes a clutch lever 71 and a controlled portion 72. In this embodiment, the clutch lever 71 is a rod, but is not limited to this implementation, and it can also be integrally formed. The clutch lever 71 is inserted in the through hole 41 of the clutch seat 40. When the clutch member 70 is in the engaged position (as shown in FIGS. 3 and 6), the clutch lever 71 is inserted into both the through hole 41 of the clutch seat 40 and the clutch hole 51 of the actuating seat 50, so that the actuating seat 50, the passive member 30 and the clutch seat 40 are directly driven and moved synchronously through the drive shaft 20. When the clutch member 70 is in the disengaged position (as shown in FIGS. 8 and 11), the clutch lever 71 is inserted into the through hole 41 of the clutch seat 40 but disengaged from the clutch hole 51 of the actuating seat 50, so that the actuating seat 50 does not move synchronously with the passive member 30 and the clutch seat 40, and the drive shaft 20 is not driven. The controlled portion 72 extends along a direction perpendicular to the axis of the drive shaft 20, and is located between the passive member 30 and the clutch seat 40. In addition, the clutch member 70 in this embodiment is returnably disposed to the clutch seat 40 through a return spring 95. The return spring 95 is a tension spring, and includes a first spring end 951 disposed to the clutch seat 40, and a second spring end 952 disposed to the clutch member 70, so that the clutch member 70 can be automatically returned to the engaged position when being located in the disengaged position, and the clutch member 70 can be kept in the engaged position.

The limit rod 80 is fixed to the clutch member 70 and parallel to the axis of the drive shaft 20, and includes a limit rod portion 81 that can be inserted into the limit groove 42 and be moved with the displacement of the clutch member 70. No matter when the clutch member 70 is in the engaged position or the disengaged position, the limit rod 80 is kept inserted in the limit groove 42 of the clutch seat 40. Since the clutch lever 71 is inserted in the through hole 41 of the clutch seat 40 while the limit rod 80 is kept staying in the limit groove 42 of the clutch seat 40, the clutch member 70 can be prevented from rotating relative to the clutch seat 40.

The clutch linkage member 91 includes a first pivotable mounting portion 911 pivotally connected to the fixing plate assembly 12 of the machine frame 11, an elongated guiding slot 912, and a pushing portion 913 for moving the clutch member 70 from the engaged position to the disengaged position by pushing the controlled portion 72 of the clutch member 70.

The clutch operation member 92 includes a second pivotable mounting portion 921 pivotally connected to the fixing plate assembly 12 of the machine frame 11, an operatable portion 922 for being moved by pulling or pushing, and an actuating protrusion 923 for being inserted in the elongated guiding slot 912 of the clutch linkage member 91. The clutch operation member 92 and the clutch linkage member 91 are arranged to be perpendicular to each other, and the clutch operation member 92 can pivot from a first position (shown in FIG. 4) and a second position (shown in FIG. 9) on the second pivotable mounting portion 921 as a pivot. When the operatable portion 922 is moved to the first position, the pushing portion 913 of the clutch linkage member 91 corresponds to the controlled portion 72 of the clutch member 70. When the operatable portion 922 is moved to the second position, the actuating protrusion 923 pushes against the wall surface of the elongated guiding slot 912 to drive the clutch linkage member 91 to pivot by an angle on the first pivotable mounting portion 911 as a pivot, so that the pushing portion 913 of the clutch linkage member 91 pushes against the controlled portion 72 of the clutch member 70 to move the clutch member 70 from the engaged position to the disengaged position. The relative positions of the clutch operation member 92 and the clutch linkage member 91 can be changed depending on the cooperation state of the elongated guiding slot 912 and the actuating protrusion 923, and all these variations belong to the equivalent scope of the present invention.

The above description is directed against the configuration(s) of the main components of the embodiments of the present invention. As for the operation modes and technical effects of the present invention, please refer to the following description.

Figure 5:
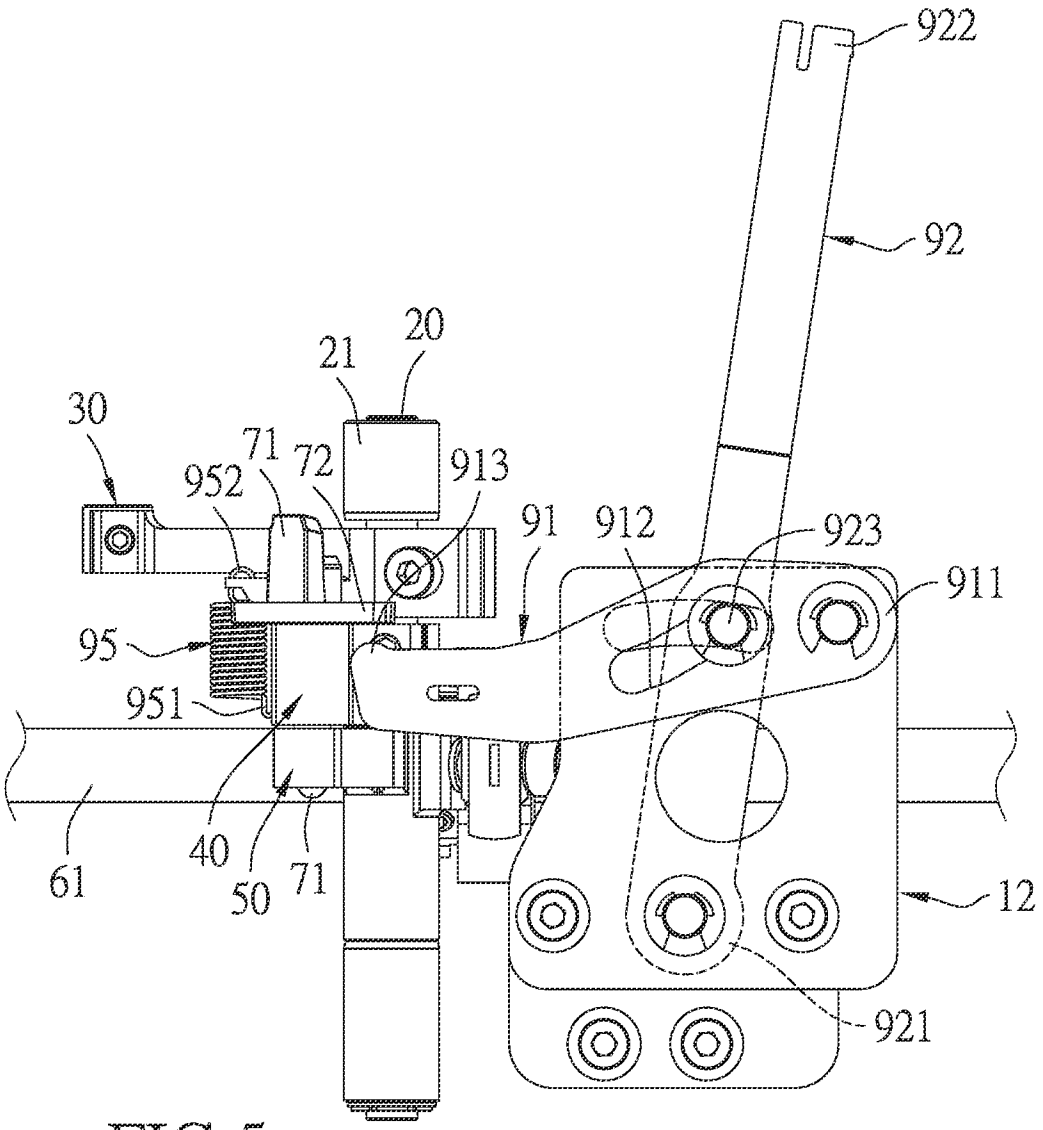
FIG. 5 is a bottom view of a part of an embodiment of the present invention.

State 1: as shown in FIGS. 3, 5 and 6, the driving clutch device of the sewing machine of the present invention being in an engaged state, where the clutch member 70 is pulled by the return spring 95 to link up the clutch seat 40 with the actuating seat 50, so that the clutch seat 40 and the actuating seat 50 together from one body and are in a coaction state; that is, the clutch lever 71 of the clutch member 70 is inserted into both the through hole 41 of the clutch seat 40 and the clutch hole 51 of the actuating seat 50, whereby the actuating seat 50 and the clutch seat 40 can be driven simultaneously through the driving member 62 to move together when the power rod 61 of the power unit 60 works. Moreover, since the clutch seat 40 and the passive member 30 are both fixed to the drive shaft 20, the passive member 30 moves with the swing of the clutch seat 40 to drive the components to be driven, such as the hook arm and the annular hook of the sewing machine.

Figure 4:
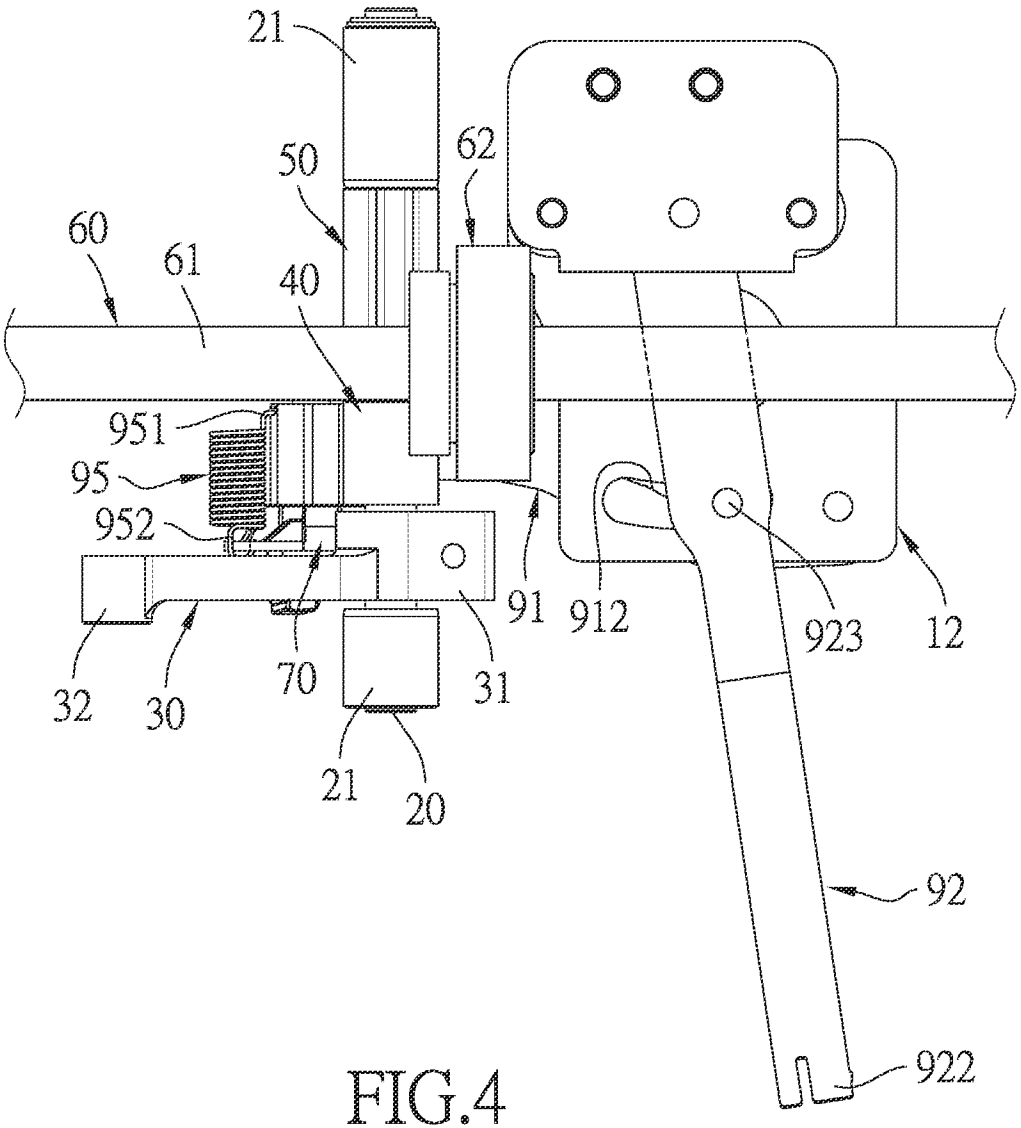
FIG. 4 is a top view of a part of an embodiment of the present invention.
Figure 9:
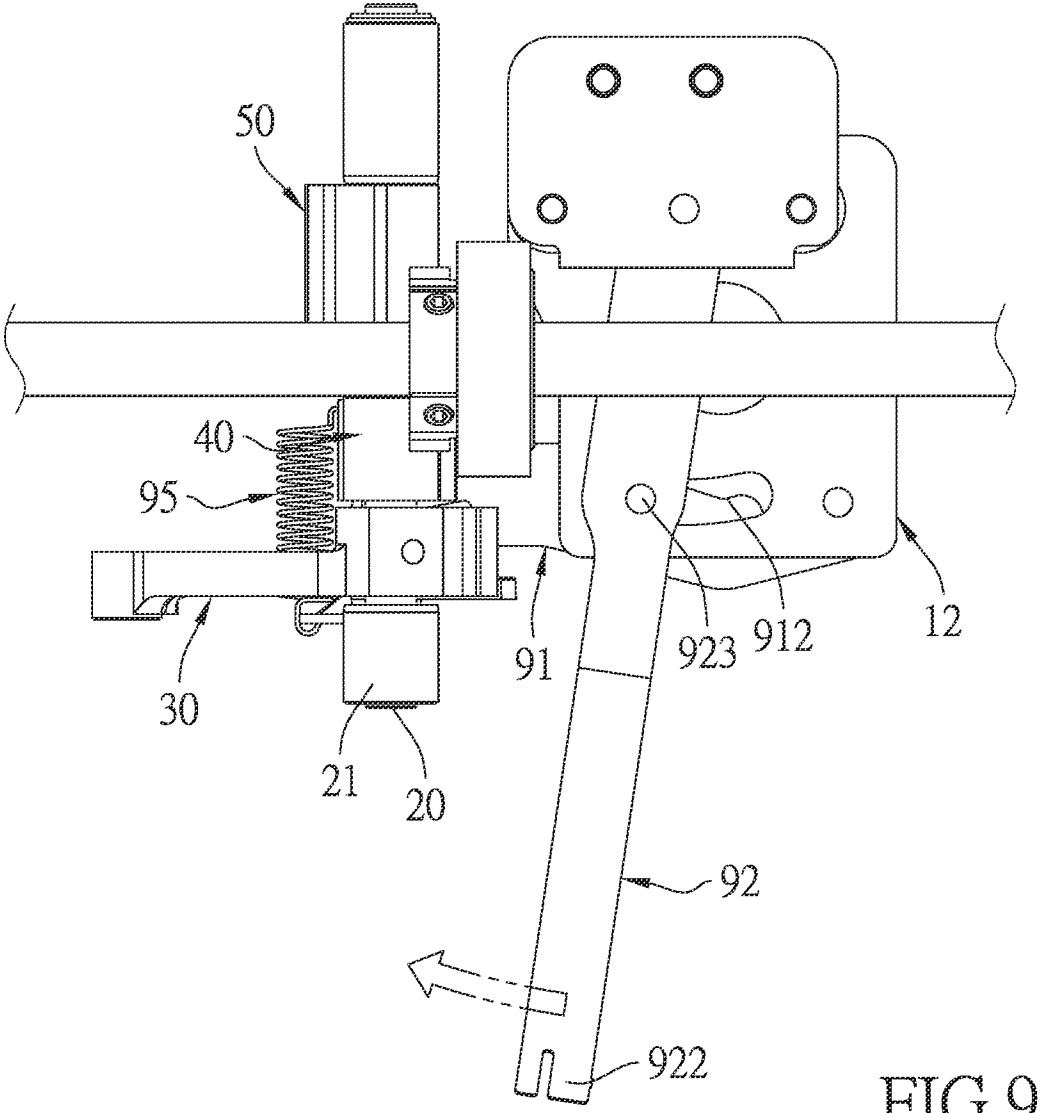
FIG. 9 is a top view of FIG. 8.
Figure 10:
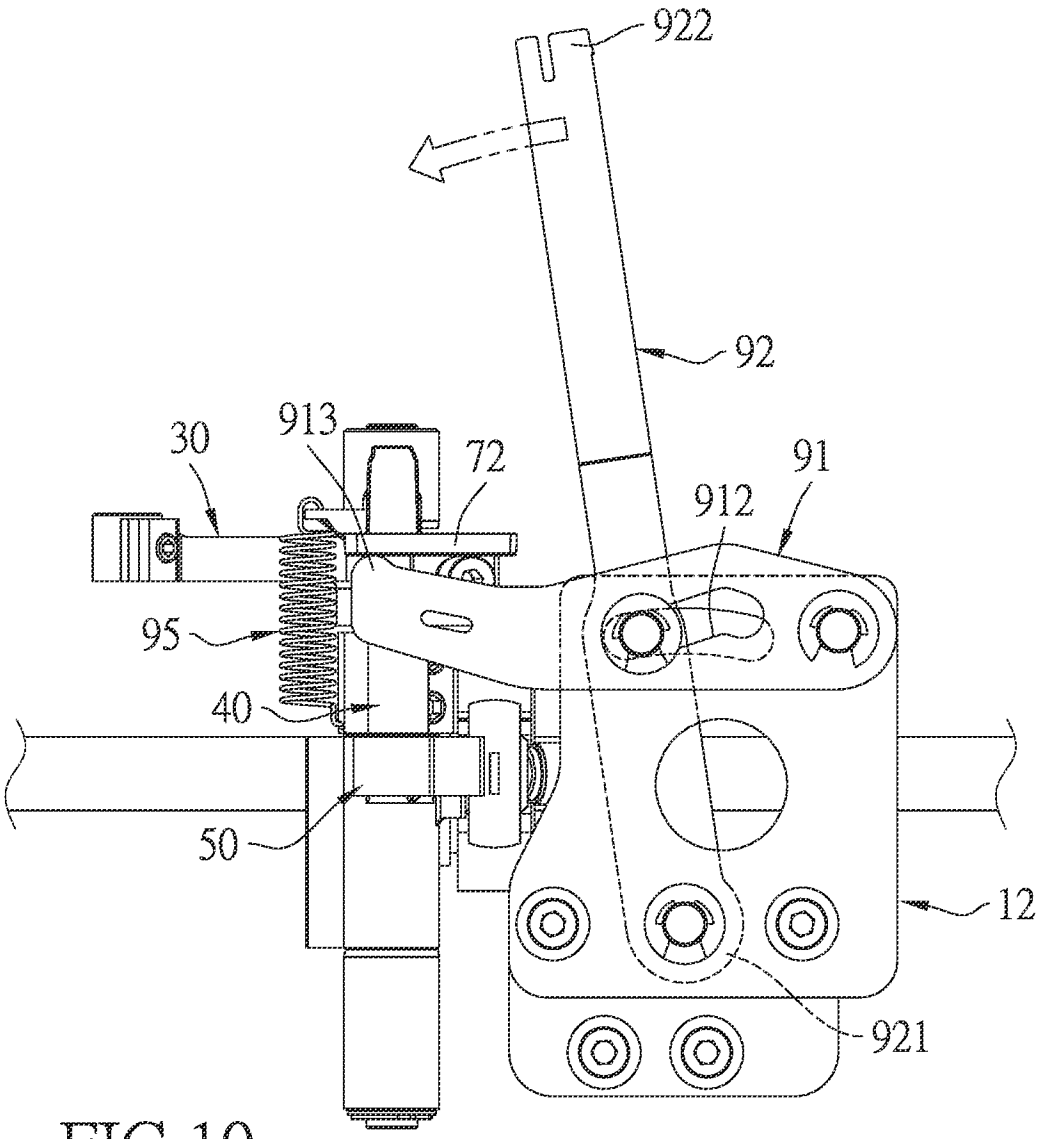
FIG. 10 is a bottom view of FIG. 8, showing a clutch member in a disengaged position.

State two: as shown in FIG. 8, FIG. 10 and FIG. 11, the driving clutch device of the sewing machine of the present invention being in a disengaged state, where, when the operatable portion 922 of the clutch operation member 92 is moved from the first position (as shown in FIG. 4) to the second position (as shown in FIG. 9), the actuating protrusion 923 of the clutch operation member 92 pushes the wall surface of the elongated guiding slot 912 of the clutch linkage member 91 to drive the clutch operation member 92 to pivot by an angle on the second pivotable mounting portion 921 as a pivot, so that the pushing portion 913 of the clutch linkage member 91 pushes against the controlled portion 72 of the clutch member 70 to move the clutch member 70 from the engaged position (as shown in FIGS. 3 and 6) to the disengaged position (as shown in FIGS. 8 and 11), that is, the clutch member 70 is displaced a distance towards the passive member 30. Therefore, the clutch lever 71 of the clutch member 70 is inserted into the through hole 41 of the clutch seat 40 but is disengaged from the clutch hole 51 of the actuating seat 50, so that the actuating seat 50 and the clutch seat 40 do not work synchronously, that is, the clutch seat 40 and the drive shaft 20 remain stationary. Furthermore, because the clutch seat 40 and the passive member 30 are both fixed on the drive shaft 20, the actuating seat 50 does not move synchronously with the passive member 30 either, the passive member 30 cannot move the components to be driven.

It is worth mentioning that when the operatable portion 922 of the clutch operation member 92 is moved from the first position (as shown in FIG. 4) to the second position (as shown in FIG. 9) to move the clutch lever 71 of the clutch member 70 away from the clutch hole 51 of the actuating seat 50, the clutch member 70, which is displaced a distance in the direction toward the passive member 30, stretches the return spring 95 whereby the return spring 95 accumulates an elastic restoring force; when a force applied on the operatable portion 922 of the clutch operation member 92 is removed, the clutch member 70 can be automatically restored from the disengaged position to the engaged position by the elastic restoring force, and therefore, the clutch operation member 92 can be automatically restored from the second position to the first position to wait for the next moving operation onto the clutch operation member 92.

Accordingly, by fixing the passive member 30 and the clutch seat 40 to the drive shaft 20, pivotally disposing the actuating seat 50 to the drive shaft 20, and returnably disposing the clutch member 70 to the clutch seat 40, the clutch seat 40 and the actuating seat 50 can move synchronously when the clutch member 70 is in the engaged position, but cannot move synchronously when the clutch member 70 is in the disengaged position, so as to achieve the driving control and the clutch control. The present invention achieves the driving control and the clutch control only by the cooperation of the clutch member 70 with the passive member 30, the clutch seat 40 and the actuating seat 50. Therefore, the design of the driving clutch device is simpler and the driving is more direct and instant, thereby reducing assembly costs and the error of action coordination.

Figure 12:
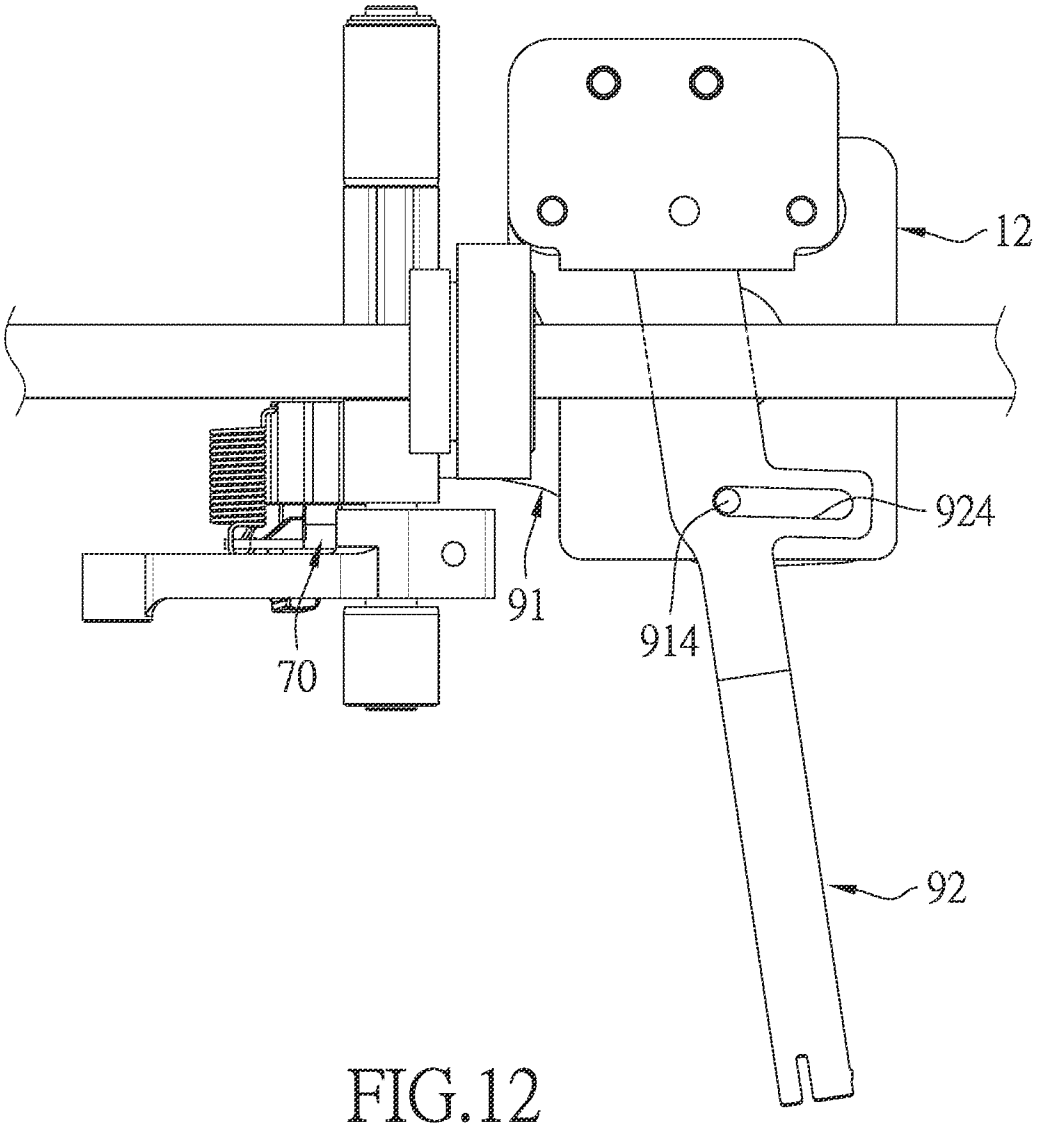
FIG. 12 is a top view of another embodiment of the present invention.

In addition, referring to FIG. 12, another embodiment of the present invention is shown, and is different from the above-mentioned embodiments in:

The clutch operation member 92 includes an elongated guiding slot 924, and the clutch linkage member 91 includes an actuating protrusion 914 for being inserted in the elongated guiding slot 924; that is, the arrangement of the elongated guiding slot and the actuating protrusion in this embodiment is reverse to that in the aforementioned embodiments, and can also achieve the control of the displacement of the clutch member 70 from the engaged position to the disengaged position, so as to achieve another implementation mode.

In summary, the above-mentioned embodiments and drawings are only preferred embodiments of the present invention, and cannot be used to limit the scope of implementation of the present invention. All the equivalent changes and modifications made in accordance with the scope of the claims of the present invention are all within the scope of the invention.

What is claimed is:

1. A driving clutch device for a sewing machine, comprising:

a drive shaft;

a passive member fixed to the drive shaft;

a clutch seat fixed to the drive shaft and including a through hole;

an actuating seat pivotally disposed to the drive shaft and including a clutch hole;

a power unit including a power rod and a driving member connected to the power rod, the driving member being pivotally connected to the actuating seat, and the power rod being configured to drive the driving member to move, so as to further drive the actuating seat to pivot reciprocatingly around an axis of the drive shaft; and a clutch member returnably disposed to the clutch seat and movable between an engaged position and a disengaged position, the clutch member including a clutch lever configured to be inserted in the through hole of the clutch seat, wherein when the clutch member is in the engaged position, the clutch lever is inserted into both of the through hole of the clutch seat and the clutch hole of the actuating seat, so that the actuating seat is moved synchronously with the clutch seat, and the passive member is driven by the drive shaft; and when the clutch member is in the disengaged position, the clutch lever is inserted into the through hole of the clutch seat but is disengaged from the clutch hole of the actuating seat, so that the actuating seat does not move synchronously with the clutch seat.

2. The driving clutch device for the sewing machine as claimed in claim 1, wherein the clutch member further includes a controlled portion, the driving clutch device further comprises a clutch linkage member and a clutch operation member, the clutch linkage member includes a first pivotable mounting portion, an elongated guiding slot, and a pushing portion for pushing the clutch member to move from the engaged position to the disengaged position, the clutch operation member includes a second pivotable mounting portion, an operatable portion for being moved, and an actuating protrusion for being inserted in the elongated guiding slot of the clutch linkage member and interactively moved with the elongated guiding slot, the clutch operation member is able to pivot from a first position and a second position on the second pivotable mounting portion as a pivot; when the clutch operation member is pivoted to the first position by pulling the operatable portion, the pushing portion corresponds to the controlled portion to keep the clutch member in the engaged position; and when the clutch operation member is pivoted to the second position by pulling the operatable portion, the actuating protrusion pushes against a wall surface of the elongated guiding slot, so that the pushing portion pushes against the controlled portion of the clutch member to move the clutch member from the engaged position to the disengaged position.

3. The driving clutch device for the sewing machine as claimed in claim 1, wherein the clutch member further includes a controlled portion, the driving clutch device further comprises a clutch linkage member and a clutch operation member, the clutch linkage member includes a first pivotable mounting portion, an actuating protrusion, and a pushing portion for pushing the clutch member to move from the engaged position to the disengaged position, the clutch operation member includes a second pivotable mounting portion, an operatable portion for being moved, and an elongated guiding slot for the actuating protrusion to insert and for guiding and being guided by the actuating protrusion, the clutch operation member is able to pivot from a first position and a second position on the second pivotable mounting portion as a pivot; when the clutch operation member is pivoted to the first position by pulling the operatable portion, the pushing portion corresponds to the controlled portion to keep the clutch member in the engaged position; and when the clutch operation member is pivoted to the second position by pulling the operatable portion, the actuating protrusion is pushed by the clutch operation member at a wall surface of the elongated guiding slot, so that the pushing portion pushes against the controlled portion of the clutch member to move the clutch member from the engaged position to the disengaged position.

4. The driving clutch device for the sewing machine as claimed in claim 1, wherein the power rod is a spinnable shaft.

5. The driving clutch device for the sewing machine as claimed in claim 1, wherein the power rod is provided with an eccentric wheel, and the power rod drives the driving member by the eccentric wheel to further drive the actuating seat to pivot reciprocatingly around the axis of the drive shaft.

6. The driving clutch device for the sewing machine as claimed in claim 1, wherein the driving member drives the actuating seat with a universal joint.

7. The driving clutch device for the sewing machine as claimed in claim 1, wherein the clutch seat further includes a limit groove, the driving clutch device further includes a limit rod fixed to the clutch member, and the limit rod includes a limit rod portion that is inserted into the limit groove while being moveable together with the clutch member.

8. The driving clutch device for the sewing machine as claimed in claim 1, further comprising a return spring, wherein the return spring includes a first spring end disposed to the clutch seat, and a second spring end disposed to the clutch member, so that the clutch member is automatically returnable to the engaged position when being located in the disengaged position.

9. The driving clutch device for the sewing machine as claimed in claim 1, wherein the clutch seat and the passive member are integrally formed as one piece.

* * * * *